US011710595B2

(12) United States Patent
Lai et al.

(10) Patent No.: US 11,710,595 B2
(45) Date of Patent: Jul. 25, 2023

(54) MAGNETIC COMPONENT STRUCTURE WITH THERMAL CONDUCTIVE FILLER AND METHOD OF FABRICATING THE SAME

(71) Applicant: CYNTEC CO., LTD., Hsinchu (TW)

(72) Inventors: Yi-Ting Lai, Hsinchu (TW); Jen-Chuan Hsiao, Hsinchu (TW); Yuan-Ming Chang, Hsinchu (TW); Hsieh-Shen Hsieh, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 590 days.

(21) Appl. No.: 16/809,511

(22) Filed: Mar. 4, 2020

(65) Prior Publication Data

US 2020/0286667 A1 Sep. 10, 2020

Related U.S. Application Data

(60) Provisional application No. 62/816,213, filed on Mar. 10, 2019.

(51) Int. Cl.

| | |
|---|---|
| ***H01F 27/22*** | (2006.01) |
| ***H01F 27/24*** | (2006.01) |
| ***H01F 27/28*** | (2006.01) |
| ***H01F 27/02*** | (2006.01) |
| ***H01F 41/04*** | (2006.01) |
| ***H01F 1/147*** | (2006.01) |
| ***H01F 1/34*** | (2006.01) |
| ***H01F 41/02*** | (2006.01) |
| ***H01F 27/32*** | (2006.01) |

(52) U.S. Cl.

CPC ..... *H01F 27/22* (2013.01); *H01F 1/14708* (2013.01); *H01F 1/14766* (2013.01); *H01F 1/344* (2013.01); *H01F 27/02* (2013.01); *H01F 27/24* (2013.01); *H01F 27/28* (2013.01); *H01F 27/325* (2013.01); *H01F 41/0246* (2013.01); *H01F 41/04* (2013.01)

(58) Field of Classification Search

USPC ..... 336/55–60, 221, 192

See application file for complete search history.

(56) References Cited

U.S. PATENT DOCUMENTS 4,977,039 A * 12/1990 Onishi ..... H01B 12/10 428/930
6,392,519 B1 * 5/2002 Ronning ..... H01F 27/025 336/61
2014/0320256 A1 10/2014 Inaba (Continued)

FOREIGN PATENT DOCUMENTS

CN 1484258 A 3/2004
CN 104025218 A 9/2014

(Continued)

*Primary Examiner* — Shawki S Ismail
*Assistant Examiner* — Kazi S Hossain
(74) *Attorney, Agent, or Firm* — Winston Hsu

(57) ABSTRACT

An magnetic component structure with thermal conductive filler is provided in the present invention, including an upper magnetic core, a lower magnetic core combining with the upper magnetic core to form a casing with a front opening and a rear opening, and a coil mounted in the casing, where two terminals of the coil extend outwardly from the front opening, and a thermal conductive filler filling between the casing and the coil in the casing.

15 Claims, 11 Drawing Sheets

(56) References Cited

U.S. PATENT DOCUMENTS

| | | | | |
|---|---|---|---|---|
| 2016/0217916 | A1 | 7/2016 | Yan | |
| 2017/0004920 | A1 | 1/2017 | Pan | |
| 2018/0350512 | A1* | 12/2018 | Yang | H01F 27/22 |
| 2019/0302151 | A1* | 10/2019 | Manikandan | H02H 1/0007 |
| 2020/0381171 | A1* | 12/2020 | Sakaguchi | H01F 27/02 |

FOREIGN PATENT DOCUMENTS

| | | | | | |
|---|---|---|---|---|---|
| CN | 104240926 | A | * | 12/2014 | |
| CN | 106328356 | A | * | 1/2017 | H01F 27/2823 |
| CN | 106328356 | A | | 1/2017 | |
| TW | 201628027 | A | | 8/2016 | |
| TW | 201701312 | A | | 1/2017 | |

* cited by examiner

MAGNETIC COMPONENT STRUCTURE WITH THERMAL CONDUCTIVE FILLER AND METHOD OF FABRICATING THE SAME

CROSS REFERENCE TO RELATED APPLICATIONS

This application claims priority to U.S. Provisional Patent Application No. 62/816,213, filed on Mar. 10, 2019, the disclosure of which is incorporated herein by reference in its entirety.

BACKGROUND OF THE INVENTION

1. Field of the Invention

The present invention relates generally to a magnetic component structure, and more specifically, to a magnetic component structure with thermal conductive filler.

2. Description of the Related Art

Magnetic component for example transformer or inductor, also called reactor, is a passive two-terminal electrical component which resists changes in electric current passing through it. It consists of a conductor such as a wire, usually wound into a coil. When a current flows through it, energy is stored temporarily in a magnetic field in the coil. When the current flowing through an inductor changes, the time-varying magnetic field induces a voltage in the conductor according to Faraday's law of electromagnetic induction, which opposes the change in current that created it. Many magnetic components have a magnetic core made of iron or ferrite inside the coil, which serves to increase the magnetic field and thus the inductance.

Magnetic components are widely used in alternating current (AC) electronic equipment, particularly in radio equipment, power transfer or power isolation. For example, inductors are used to block the flow of AC current while allowing DC to pass. The inductors designed for this purpose are called chokes. They are also used in electronic filters to separate signals of different frequencies, and in combination with capacitors to make tuned circuits.

The development and popularity of 5G wireless systems and automotive electronics offer a huge business opportunity to those industries in the field. Extreme demand for passive components like inductors or transformer makes them in quite short supply. Furthermore, 5G wireless systems and automotive electronics need stricter specifications and requirements for the characteristics of magnetic component. For example, how to effectively and quickly dissipate the heat generated by coils and magnetic cores in the magnetic component becomes a critical issue, since increased amount of heat generation and accumulation may rise the temperature of magnetic component in operation and deteriorate their performance, or eventually, burn down the whole device. Accordingly, there is a need for an improved method and construction for dissipating heat from magnetic cores and coils in magnetic component.

SUMMARY OF THE INVENTION

In order to improve the heat dissipation of magnetic component, the present invention provides a magnetic component structure with thermal conductive fillers between coil and magnetic cores to boost heat conduction therebetween.

Unique design for the thermal conductive filler provides improved heat dissipation as well as reducing the manufacturing cost. In addition, the size of coils and magnetic cores may be accordingly reduced to easily achieve desired inductance and facilitate the miniaturization of the magnetic component.

One aspect of the present invention is to provide a magnetic component structure with thermal conductive filler, including an upper magnetic core and a lower magnetic core, wherein the upper magnetic core and the lower magnetic core combines to form a casing with a front opening and a rear opening, a coil mounted in the casing, where two terminals of the coil extending outwardly from the front opening, and a thermal conductive filler filling between the casing and the coil in casing.

Another aspect of the present invention is to provide a method of fabricating a magnetic component structure with thermal conductive filler, including steps of providing a mold with a coil mounted therein, potting the mold with a thermal conductive material to form a thermal conductive filler encapsulating at least a part of the coil, releasing the thermal conductive filler and the coil from the mold, and combining the thermal conductive filler with magnetic cores to form a magnetic component structure.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The accompanying drawings are included to provide a further understanding of the embodiments, and are incorporated in and constitute apart of this specification. The drawings illustrate some of the embodiments and, together with the description, serve to explain their principles. In the drawings.

Figure 1:
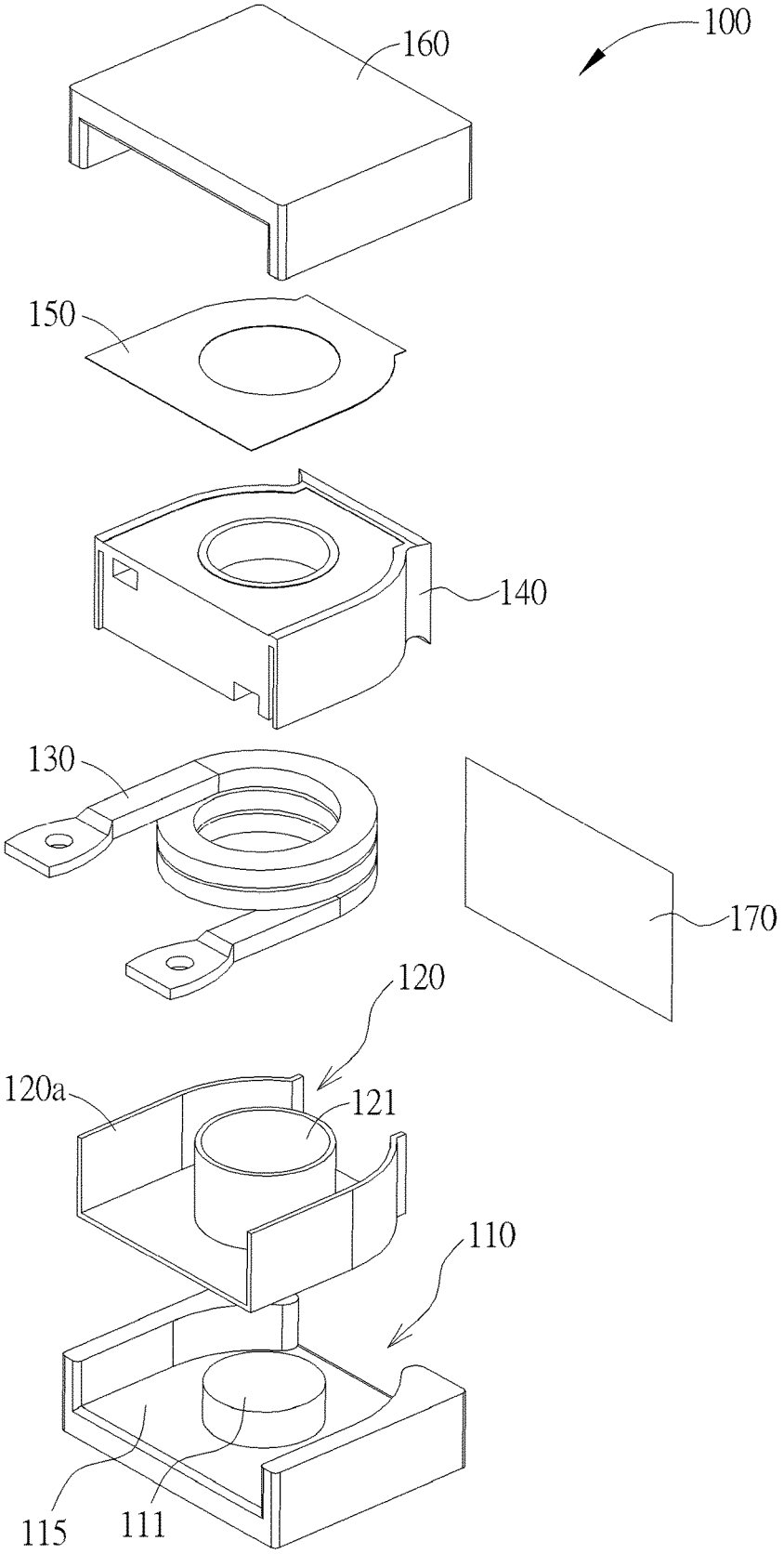
FIG. 1 is an exploded view of a magnetic component structure in accordance with one embodiment of the present invention.

It should be noted that all the figures are diagrammatic. Relative dimensions and proportions of parts of the drawings have been shown exaggerated or reduced in size, for the sake of clarity and convenience in the drawings. The same reference signs are generally used to refer to corresponding or similar features in modified and different embodiments.

DETAILED DESCRIPTION

In following detailed description of the present invention, reference is made to the accompanying drawings which form a part hereof and is shown by way of illustration and specific embodiments in which the invention may be practiced. These embodiments are described in sufficient details to enable those skilled in the art to practice the invention. Dimensions and proportions of certain parts of the drawings may have been shown exaggerated or reduced in size, for the sake of clarity and convenience in the drawings. Other embodiments may be utilized and structural, logical, and electrical changes may be made without departing from the scope of the present invention. The following detailed description, therefore, is not to be taken in a limiting sense, and the scope of the present invention is defined by the appended claims.

First, please refer to FIG. 1, which is an exploded view of a magnetic component structure 100 in accordance with one preferred embodiment of the present invention. This figure shows relative positions and arrangements of elements in the magnetic component structure 100. The magnetic component structure 100 shown in this embodiment may include, from bottom to top, a lower magnetic core 110, a bobbin 120, at least one coil 130, a thermal conductive filler 140, an insulating paper or film 150 and an upper magnetic core 160. The lower magnetic core 110 is provided with a center column 111 extending upwardly from the mounting plane 115 for the bobbin 120 and/or the coil 130 to be mounted thereon. The bobbin 120 may be a bobbin frame with a shape corresponding to the profile of inner sidewalls and the mounting plane of the lower magnetic core 110 and a hollow center cylinder 121 corresponding to and may be mounted on the center column 111 of lower magnetic core 110. The coil 130 is wound and mounted around the center cylinder 121 of bobbin 120. In the embodiment of the present invention, the bobbin 120 further includes two cover walls 120*a* conformal with the outer sides of the coil 130 to improve the insulation between the coil 130 and the core 110, 160. The coil 130 is wound independently and then mounted on the bobbin 120 by fitted on the center column 111.

The upper magnetic core 160 has a shape corresponding to the lower magnetic core 110 and, after assembly, it is combined with the lower magnetic core 110 to enclose all aforementioned elements of the magnetic component structure 100. The thermal conductive filler 140 is filled up and formed in at least a portion of or whole remaining enclosed space between the upper magnetic core 160 and the lower magnetic core 110. The insulating paper 150 is disposed between the thermal conductive filler 140 and the upper magnetic core 160 to provide better insulating property. Optionally, an elastic tape 170 may be adhered behind the magnetic component structure 100 to seal the rear opening formed by the combined upper magnetic core 160 and lower magnetic core 110. Please note that the arrangement and configuration identified above is an exemplary preferred embodiment of the present invention. Certain elements like the bobbin 120, the insulating paper 150 and/or the elastic tape 170 may not be provided in real implementation or may be replaced with other elements. In addition, various modifications and additions relevant to the elements may be made in variant embodiments. In addition, the front opening and the rear opening formed after assembly are opposite to each other respectively in two parallel and opposite directions of expansion stress. The function of openings is to release the expansion stress generated by heat in the operation, so that the stress withstood for the core 110, 160 may be significantly reduced. The thermal conductivity of thermal conductive filler and thermal conductive interface material is larger than about 0.3 W/mk (watts per meter-kelvin). In one embodiment, the thermal conductive filler doesn't encapsulate the outer surfaces of the upper magnetic core 160 and the lower magnetic core 110.

In the present invention, the material of the upper magnetic core 160 and lower magnetic core 110 may be powder core with lower relative permeability, such Fe—Si based alloy and Fe—Ni based alloy, or ferrite core with higher relative permeability. The material of insulating paper/film 150 may be Dupont Nomex® or Dupont Kapton®, with a thickness enough to achieve insulating requirement and an area larger than the top area of electrified coil 130. The material of bobbin 120 may be plastics (ex. engineering plastics) that can bear the tension in coil winding process. The material of thermal conductive filler 140 may be inorganic material with good thermal conductivity, such as epoxy, silicon, or polyurethane (PU), or may be materials with thermal conductivity larger than 0.3 W/mk, such as thermoset phenolic resins, thermoplastic polyethylene terephthalate (PET), polyamide (PA), polyphenylene sulfide (PPS) and polyetheretherketone (PEEK).

Figure 2:
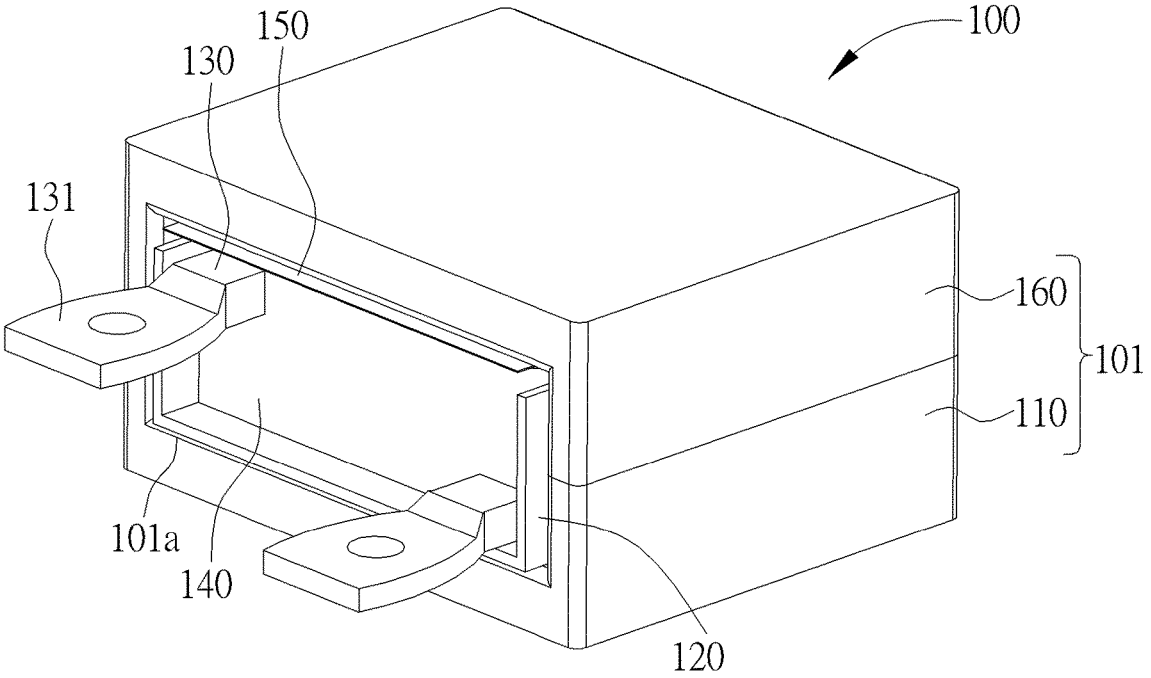
FIG. 2 is a front perspective view of a magnetic component structure after assembly in accordance with one embodiment of the present invention.

Next, please refer to FIG. 2, which is a front perspective view of a magnetic component structure 100 after assembly in accordance with one embodiment of the present invention. The lower magnetic core 110 and the upper magnetic core 160 are combined to form a casing 101 containing the elements of magnetic component structure 100 inside. A front opening 101*a* is formed for terminals 131 of the coil 130 to extend outwardly in front of the casing 101. The bobbin 120 is mounted along a portion of inner sidewalls of the casing 101, with the thermal conductive filler 140 filling up inner, at least partial or whole remaining space and encapsulating at least partial or whole coil 130 (two terminals 131 excluded) and the bobbin 120. The insulating paper 150 is disposed between the shaped thermal conductive filler 140 and the upper magnetic core 130.

In the operation, the heat generated by the coil 130 may be first conducted to the thermal conductive filler 140 encapsulating therearound. The thermal conductive filler 140, with superior thermal conductive property, may effectively conduct the heat from the coil 130 to the surrounding casing 101, with the insulating paper 150 facilitating the conduction therebetween. The upper and lower magnetic cores 160 and 110, which are inherently good thermal conductors, may further conduct the heat to external heat dissipating structures like cooling plates of cellphone or vehicle on which the magnetic component structure 100 is mounted.

In one embodiment, the thermal conductive filler 140 is formed by potting the mold consist of an upper magnetic core 160 and a lower magnetic core 110 with a thermal conductive material to form a thermal conductive filler 140 encapsulating fully or partially the coil 130 already mounted therein.

Figure 3:
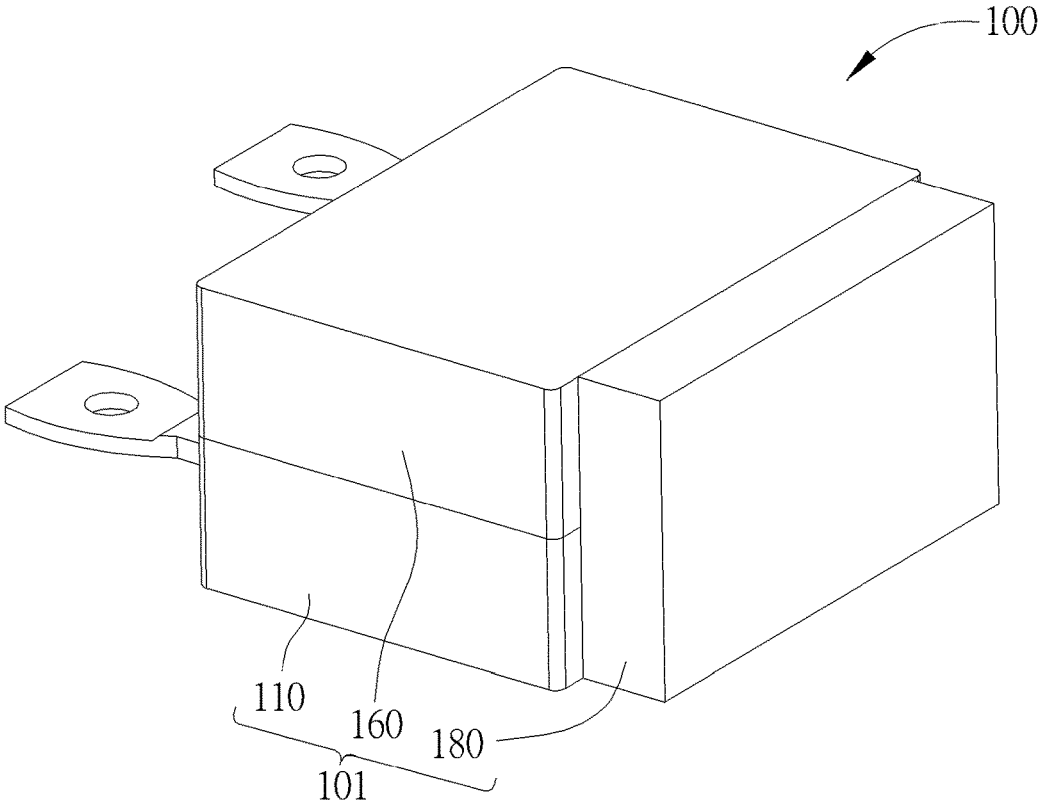
FIG. 3 is a rear perspective view of a magnetic component structure in accordance with one embodiment of the present invention.

Next, please refer to FIG. 3, which is a rear perspective view of a magnetic component structure 100 in accordance with one embodiment of the present invention. The rear opening (not shown) formed by the combined lower magnetic core 110 and upper magnetic core 160 may be blocked by a cover 180. In this embodiment, the cover 180 is a part of casing 101 and may be bonded on the rear side of upper and lower magnetic cores 160 and 110 with a shape flush with the shape of casing 101. The cover 180 is added in the magnetic component structure 100 to seal the rear opening of casing 101 so that the thermal conductive filler may be retained in the enclosed space until it is cured in a potting process. In this embodiment, the surface of thermal conductive filler may be flush with the rear opening of casing 101.

Figure 4:
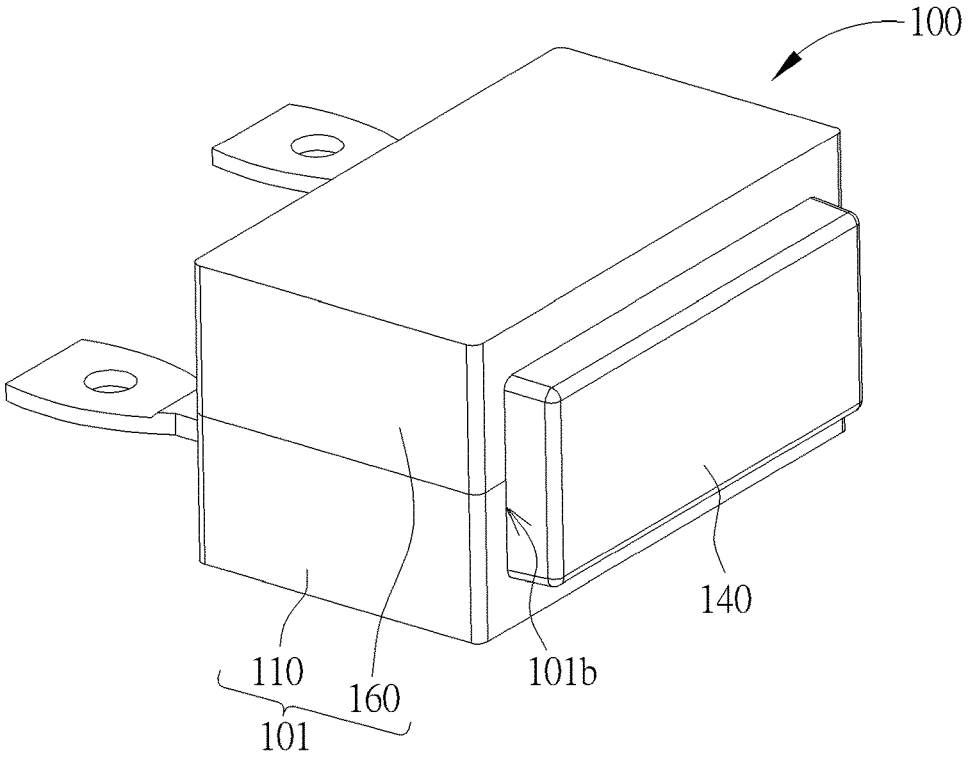
FIG. 4 is a rear perspective view of a magnetic component structure in accordance with another embodiment of the present invention.

Next, please refer to FIG. 4, is a rear perspective view of a magnetic component structure 100 in accordance with another embodiment of the present invention. In this embodiment, the rear opening 101*b* of casing 101 is not blocked by a cover like the one shown in FIG. 3, so that the thermal conductive filler 140 may project outwardly from the inner space of casing 101. This design is suitable for those magnetic component structures with a portion of the coil out of rear range of the casing 101. The projecting thermal conductive filler 140 may fully encapsulate this kind of coil even if it is out of rear range of the casing 101. In the manufacture, this projecting structure is formed by potting the thermal conductive material with a mold made of the upper and lower magnetic cores 160, 110 and an additional rear mold piece (not shown) similar to the cover 180 in FIG. 3. The rear mold piece provides an inner molding space to shape the projecting portion of the thermal conductive filler 140. After the thermal conductive filler 140 is cured, the rear mold piece is released from the magnetic cores 110, 160 and the thermal conductive filler 140. This projecting thermal conductive structure may also provide better heat dissipating efficiency if it is contacted with external cooling structures.

Figure 5:
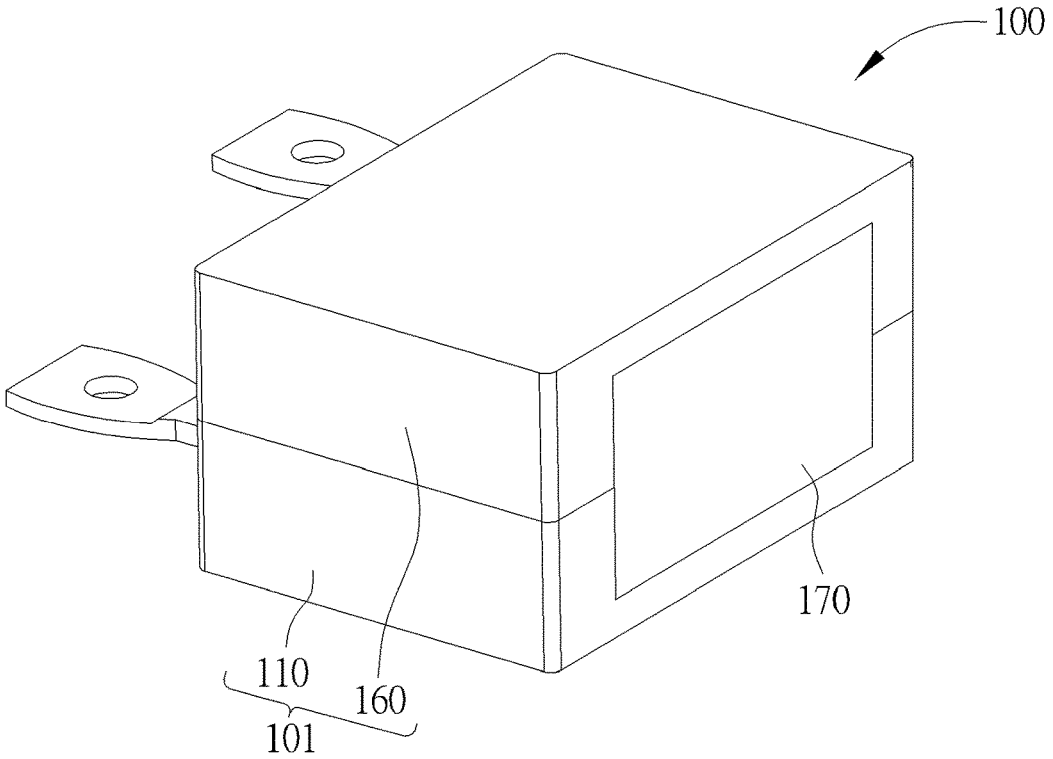
FIG. 5 is a rear perspective view of a magnetic component structure in accordance with still another embodiment of the present invention.

Next, please refer to FIG. 5, which is a rear perspective view of a magnetic component structure in accordance with still another embodiment of the present invention. In this embodiment, instead of using a rear cover 180 blocking the rear opening of casing 101 like the one shown in FIG. 3, the rear opening may be sealed by using an adhesive elastic tape 170 adhering on the rear side of the casing 101. The advantage of this design is it provides flexible space and allowance for the thermal conductive filler formed in the casing 101. In real manufacture, cured thermal conductive filler may applies a considerable stress to the combined magnetic cores 110, 160 and even can crack the magnetic cores 110 if there are not enough space for the thermal conductive filler to expand. The applied elastic tape 170 may serve as a bottom cover to retain the thermal conductive filler in the potting process and, if required, it may be detached by cured, expanding thermal conductive filler to provide an outwardly-expanding space. If not expanding, the surface of thermal conductive filler will be flush with the rear opening of the casing 101.

Figure 6:
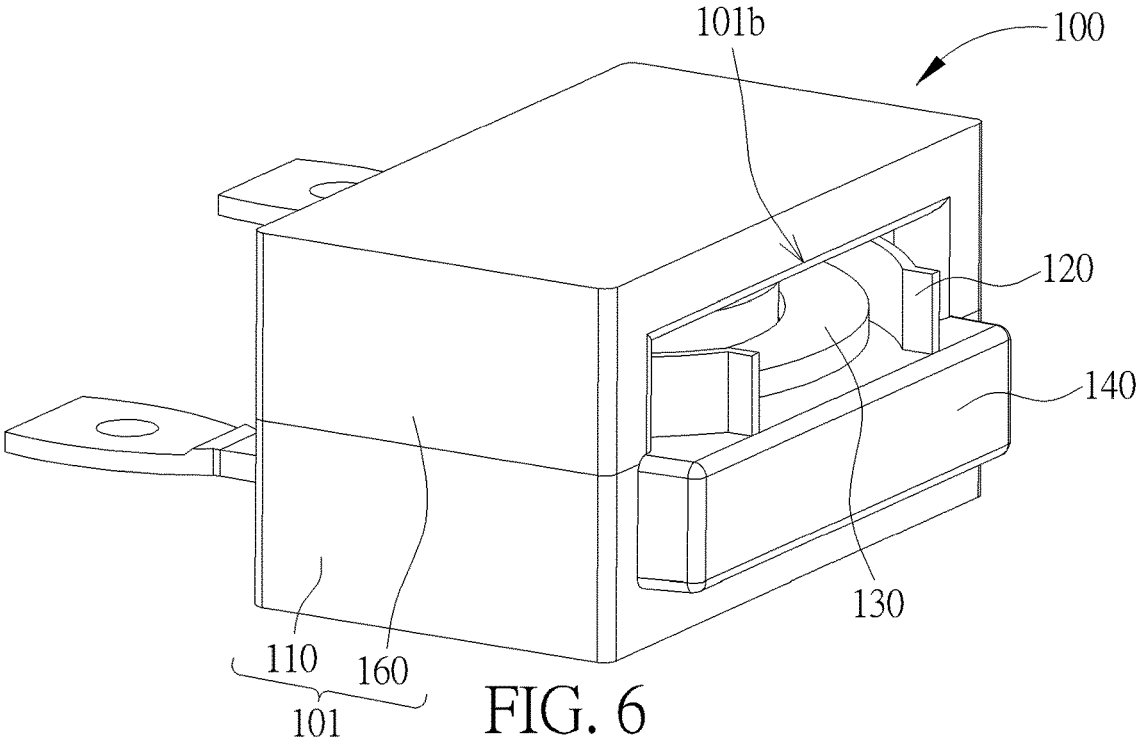
FIG. 6 is a rear perspective view of a magnetic component structure in accordance with still another embodiment of the present invention.

Next, please refer to FIG. 6, which is a rear perspective view of a magnetic component structure 100 in accordance with still another embodiment of the present invention. In another variant of present invention, the thermal conductive filler 140 in the magnetic component structure 100 may be formed in a half-filled or partially-filled mode. As shown in FIG. 6, the thermal conductive filler 140 is half-filled from the lower magnetic core 110 toward the upper magnetic core 160. A portion of the half-filled thermal conductive filler 140 projects outwardly from the rear opening 101*b* of casing 101 like the one shown in FIG. 4. It can be seen in FIG. 6 that portions of the bobbin 120 and the coil 130 are exposed from the thermal conductive filler 140 in the unfilled space. That is, the thermal conductive filler 140 in this embodiment does not fully encapsulate those internal elements. The advantage of this half-filled or partially-filled mode is it can save significant material cost and reduce expansion stress caused by heat in the operation, since nearly only half quantity of the thermal conductive filler 140 is required in this manufacturing process, and at the same time, it maintains appropriate heat conducting property since it has enough thermal conductive contact area between the thermal conductive filler 140 and the lower magnetic core 110. In the manufacture, this half-filled and projecting structure may be formed by curing the thermal conductive filler 140 in a lateral potting process. Supplementary mold pieces are necessary in front and rear of the casing 101 to retain uncured thermal conductive material until it is cured into the thermal conductive filler 140.

Figure 7:
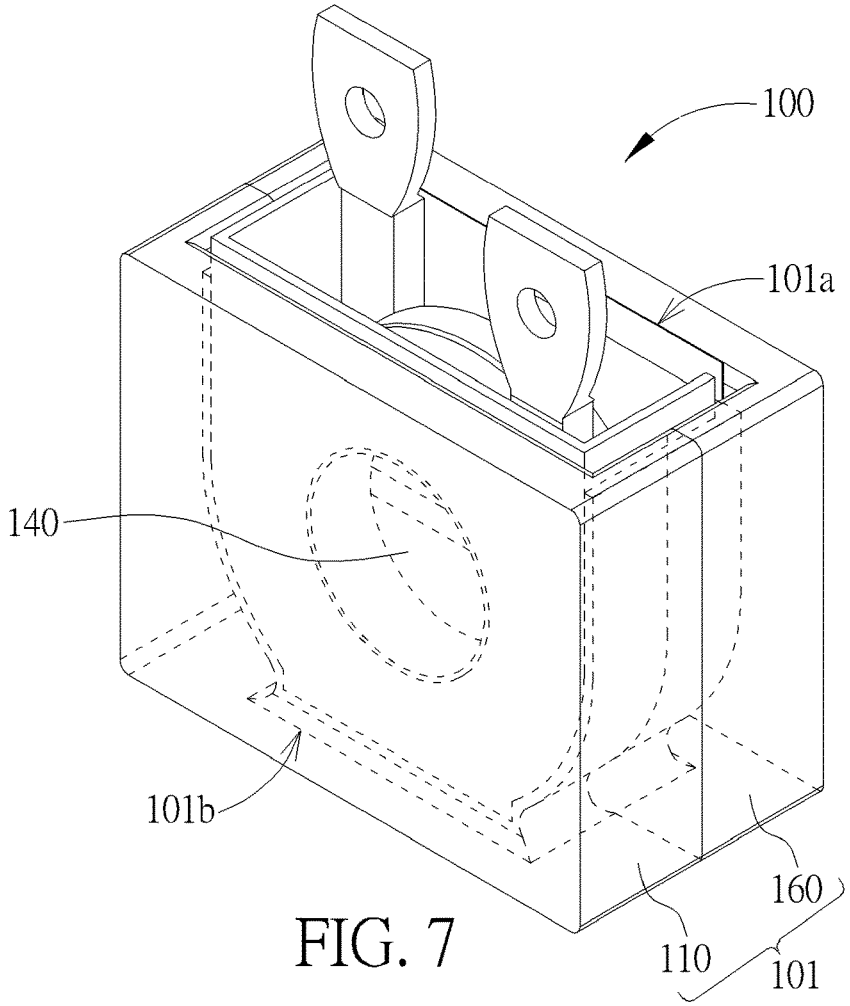
FIG. 7 is a bottom perspective view of a magnetic component structure in accordance with one embodiment of the present invention.

Next, please refer to FIG. 7, which is a bottom and inner perspective view of a magnetic component structure 100 in accordance with one embodiment of the present invention. Similar to the embodiment of FIG. 6, the thermal conductive filler 140 of this embodiment is also in a half-filled or partially-filled mode. However, in this embodiment, the thermal conductive filler 140 is formed by an upright potting process, with an elastic tape or cover blocking the rear opening 101*b* of the casing 101. The thermal conductive filler 140 partially fills up the casing 101 from the rear opening 101*b* to the front opening 101*a*. In comparison to the embodiment of FIG. 6, the contact area between thermal conductive filler 140 and lower magnetic core 110 in this embodiment is much smaller. Although the heat conducting ability is compromised, the advantage of this design is it adopts simple upright potting process. The potting, uncured thermal conductive filler 140 may be easily retained in the formation without the help of supplementary mold pieces. The outer surface of cores 110, 160 opposite to the thermal conductive filler 140 would be the cooling surface to contact with a cooler.

Figure 8A:
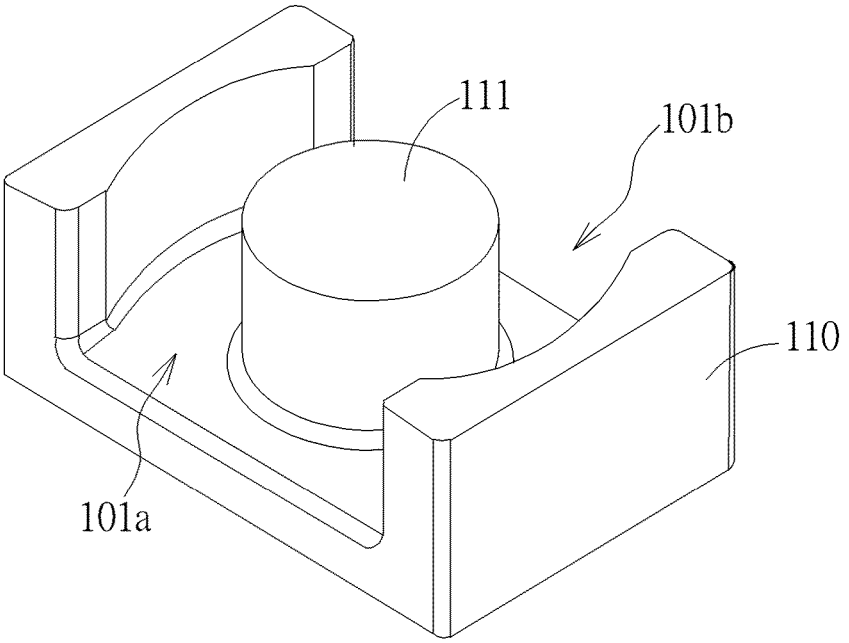
FIGS. 8*a* and 8*b* are perspective views of lower magnetic cores of the magnetic component structure in accordance with two embodiments of the present invention.
Figure 8B:
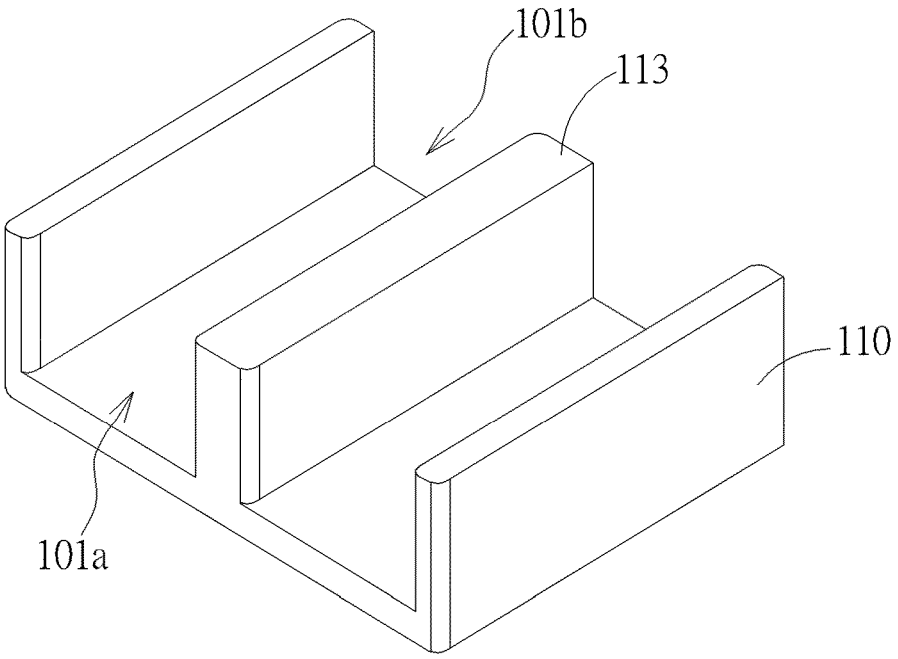

Next, please refer to FIGS. 8*a* and 8*b*, which are perspective views of the lower magnetic cores 110 of magnetic component structure in accordance with two embodiments of the present invention. The magnetic component structure in the present invention may adopt various types of lower magnetic cores 110, such as EQ-core shown in FIG. 8*a* and E-core shown FIG. 8*b*. The EQ-type lower magnetic core 110 is provided with a center column 111 for coil or bobbin to be mounted thereon. The E-type lower magnetic core 110, unlike the aforementioned one, is provided with a center bar 113 for the coil to be wound therearound. Both of these two types of lower magnetic core 110 are provided with front openings 101*a* and rear openings 101*b* for internal elements to extend outwardly therefrom. Please note that the types of lower magnetic cores 110 identified above are merely exemplary embodiments, other types of lower magnetic cores 110 like EP-core, ER-core, ETD-core, PM-core and PQ-core may also be well applied in the present invention, to combine and bonded with a matching upper magnetic core 160 with the same core type or just using a simple I-core.

Figure 9A:
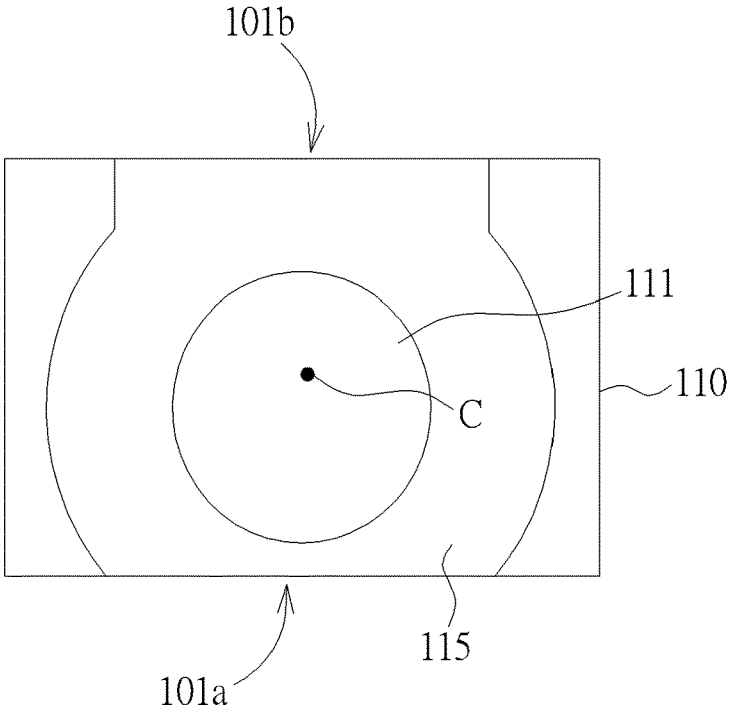
FIGS. 9*a* and 9*b* are top views of the lower magnetic cores of magnetic component structure shown in FIGS. 8*a* and 8*b* in a center-shifted form.
Figure 9B:
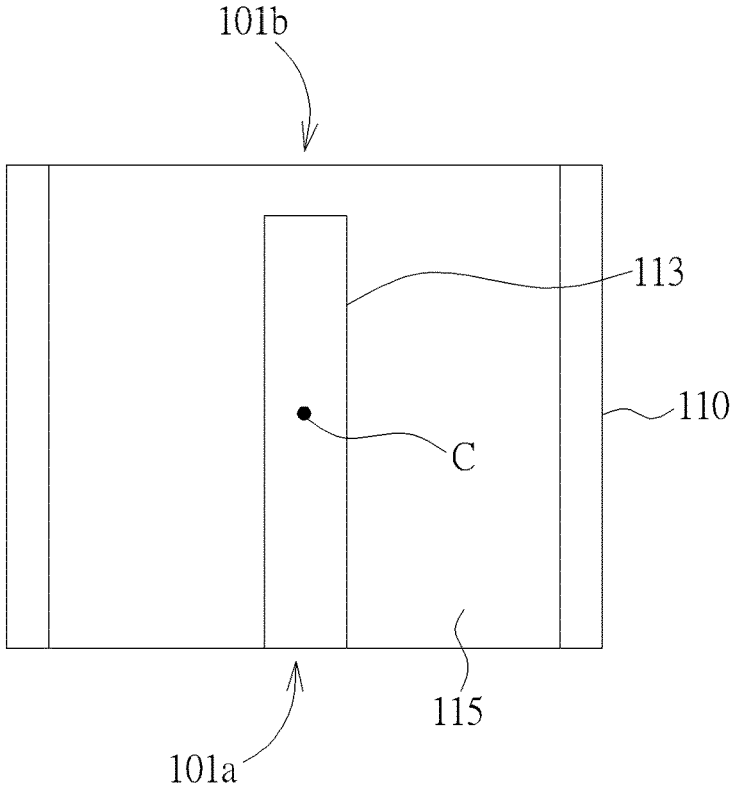
Figure 10:
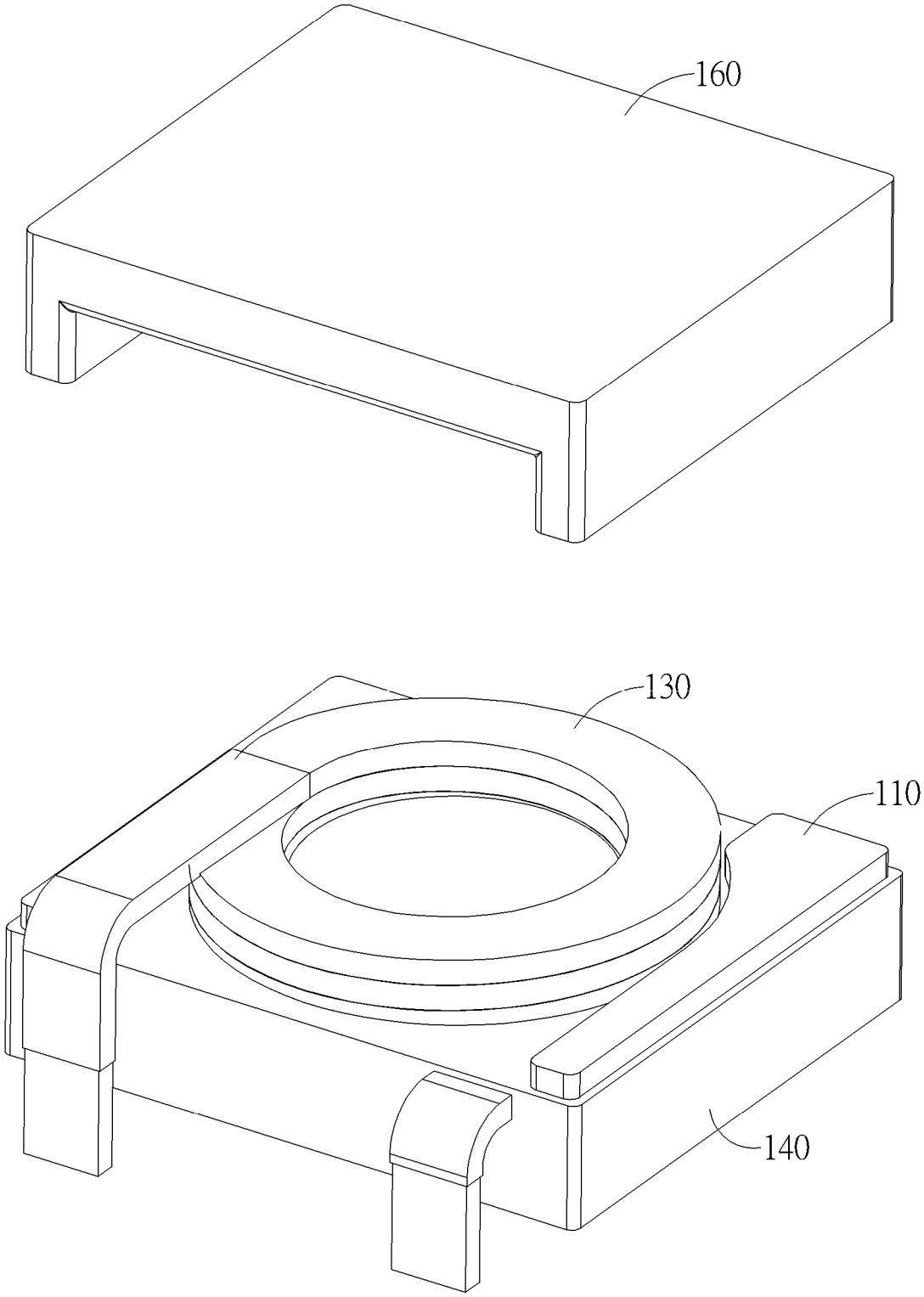
FIG. 10 is a perspective view illustrating the assembly of a magnetic component structure in accordance with one embodiment of the present invention.

Next, please refer to FIGS. 9*a* and 9*b*, which are top views of the lower magnetic cores 110 of magnetic component structure shown in FIGS. 8*a* and 8*b* respectively in a center-shifted form. As shown in the figures, the center column 111 and the center bar 113 of lower magnetic cores 110 in these two embodiments may be shifted in a distance from the center C of mounting plane 115 on the lower magnetic cores 110 toward the front opening 101*a*. The purpose of this design is to prevent the coil mounted on the center column 111 or the center bar 113 out of the rear range of lower magnetic core 110. In this way, the coil wound around the column and the bar may also be shifted toward the front opening 101*a* and the rear opening 101*b* may be sealed with an elastic tape that may be easily removed after potting and provide better flexibility in the process. The molded thermal conductive filler 140 in these two embodiment may be flush with the rear opening 101*b* rather than projecting therefrom like the one shown in FIG. 4.

After describing various structural embodiments above, now please refer to FIGS. 10-13, which are perspective views illustrating the assembly of a magnetic component structure in accordance with various embodiments of the present invention. The thermal conductive filler 140 of the present invention may be molded in various form. First, please refer to FIG. 10. In this embodiment, the thermal conductive filler 140 is formed partially encapsulating the coil 130 and nearly encapsulating entire lower magnetic core 110. In the manufacture, the thermal conductive material is potted into the mold (not shown) containing the lower magnetic core 110 and the coil 130 mounted thereon. The potted thermal conductive material is cured and takes shape into the thermal conductive filler 140 that encapsulates the lower magnetic core 110 and the lower portion of coil 130. After released from the mold, the lower magnetic core 110, including the encapsulated coil 130, are combined and bonded with the upper magnetic core 160 to form the magnetic component structure. The advantage of this design is its manufacturing process is very simple, and the fully-encapsulating thermal conductive filler 140 may provide better heat dissipating efficiency and low thermal expansion stress for the magnetic component structure in comparison to those with un-encapsulated lower magnetic core 110.

Figure 11:
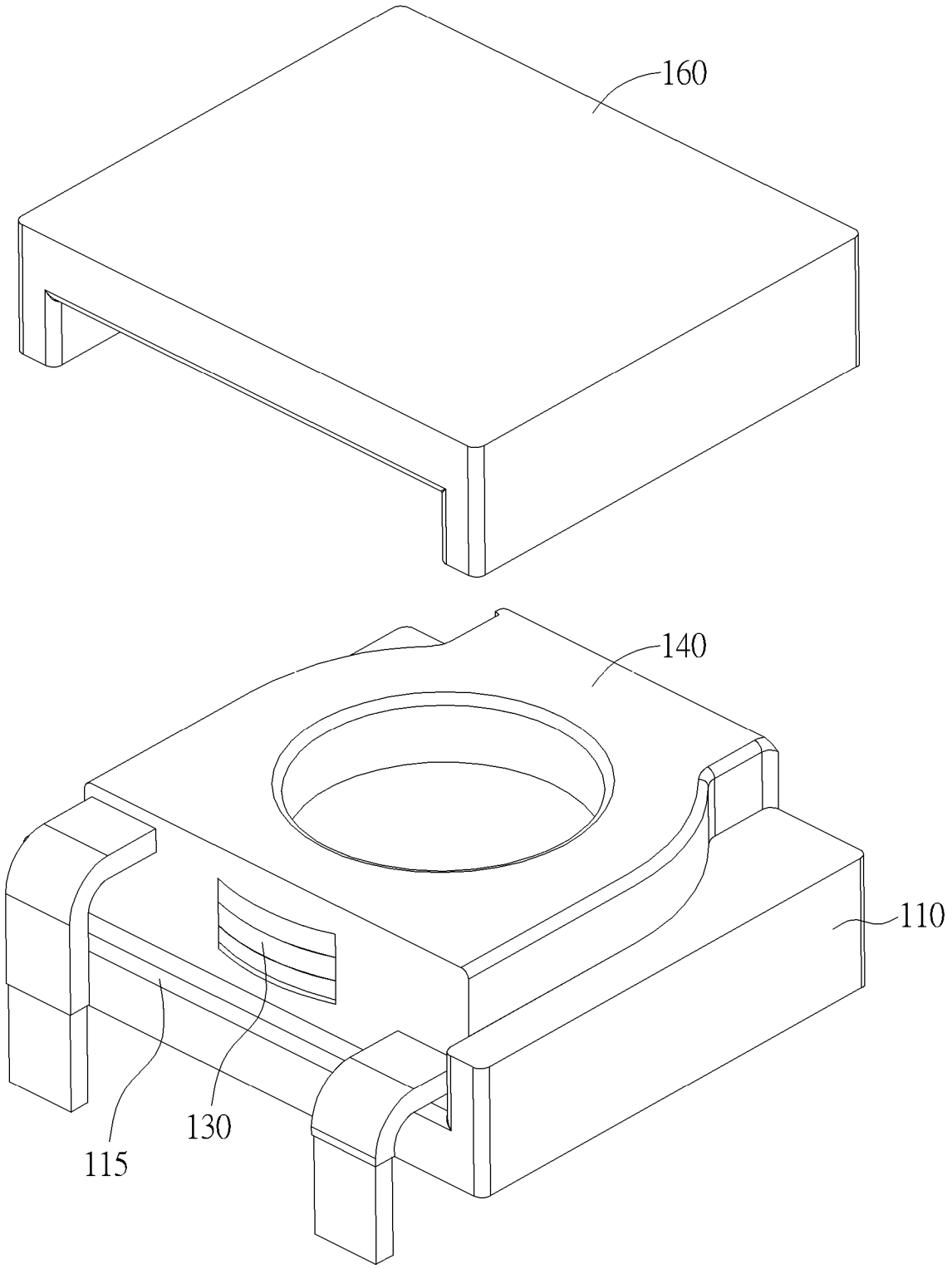
FIG. 11 is a perspective view illustrating the assembly of a magnetic component structure in accordance with another embodiment of the present invention.

Next, please refer to FIG. 11. The thermal conductive filler 140 in this embodiment may be formed together with the lower magnetic core 110 in another form. As shown in FIG. 11, the thermal conductive filler 140 is formed on the mounting plane 115 of lower magnetic core 110 with its shape conformal to at least partial or whole inner sidewalls and its rear surface flush with the rear opening of the lower magnetic core 110. The thermal conductive filler 140 in this embodiment may be formed by potting thermal conductive material into a mold made of combining lower magnetic core 110 and an upper mold piece (not shown) with predetermined shape and sidewall profiles. After the thermal conductive filler 140 is cured and released from the upper mold piece, the thermal conductive filler 140, including the lower magnetic core 110 and the coil 130 fully or partially encapsulated therein, may be combined and bonded with the upper magnetic core 160 to form the magnetic component structure. Similarly, the advantage of this design is its manufacturing process is very simple, and the thermal conductive filler 140 may be formed together with the lower magnetic core 110 to prevent engineering tolerance between shaped thermal conductive filler 140 and the magnetic cores in the assembly, especially for those sintered ferrite cores with unexpected shrunken dimension.

Figure 12:
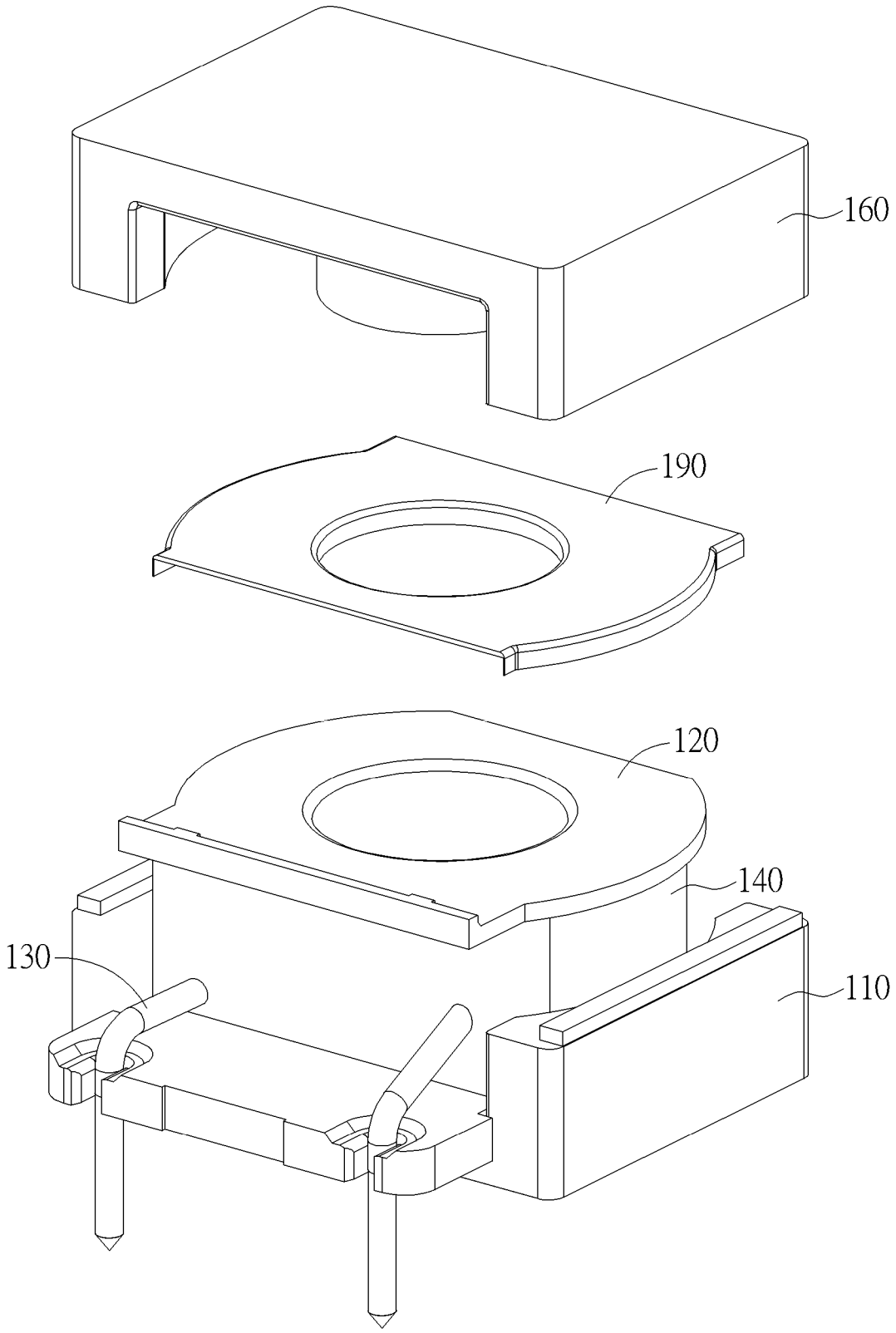
FIG. 12 is a perspective view illustrating the assembly of a magnetic component structure in accordance with still another embodiment of the present invention.

Next, please refer to FIG. 12. In this embodiment, like the one shown in FIG. 10, the thermal conductive filler 140 is formed together with the lower magnetic core 110. However, in this embodiment, the bobbin 120 is included in the formation of thermal conductive filler 140. In the manufacture, the coil 130 is first wound on the bobbin 120, and the bobbin 120 is further mounted on the lower magnetic core 110. After these three pieces are assembled, the whole piece is potted with thermal conductive material in a mold (not shown) having predetermined shape and inner profile. The coil 130 may be fully or at least partially encapsulated on the bobbin 120 and the lower magnetic core 110 by thermal conductive filler 140. Only the top surface of bobbin 120 is exposed. After released from the mold, the lower magnetic core 110, including the encapsulating thermal conductive filler 140, bobbin 120 and coil 130 mounted thereon, is combined and bonded with the upper magnetic core 160 to form the magnetic component structure. The advantage of this design is it includes bobbin 120 in the formation of thermal conductive filler 140, which is more suitable for complex structural design, such as complex coil structures or complex internal assembly. Optionally, a flexible thermal conductive interface material 190 may be disposed between the thermal conductive filler 140 and the upper magnetic core 160 or between the thermal conductive filler 140 and the lower magnetic core 110, to absorb stress caused by the thermal conductive filler 140, to fill possible gap between the bobbin 120 and the upper magnetic core 160, and to provide better insulating and heat conductive property. The flexible thermal conductive interface material 190 may be thermal adhesive, thermal grease, thermal pad or thermal gap filler, etc, with a hardness smaller than the one of thermal conductive filler 140 or/and cores 110, 160 to further lower the thermal stress and assembly tolerance.

Figure 13:
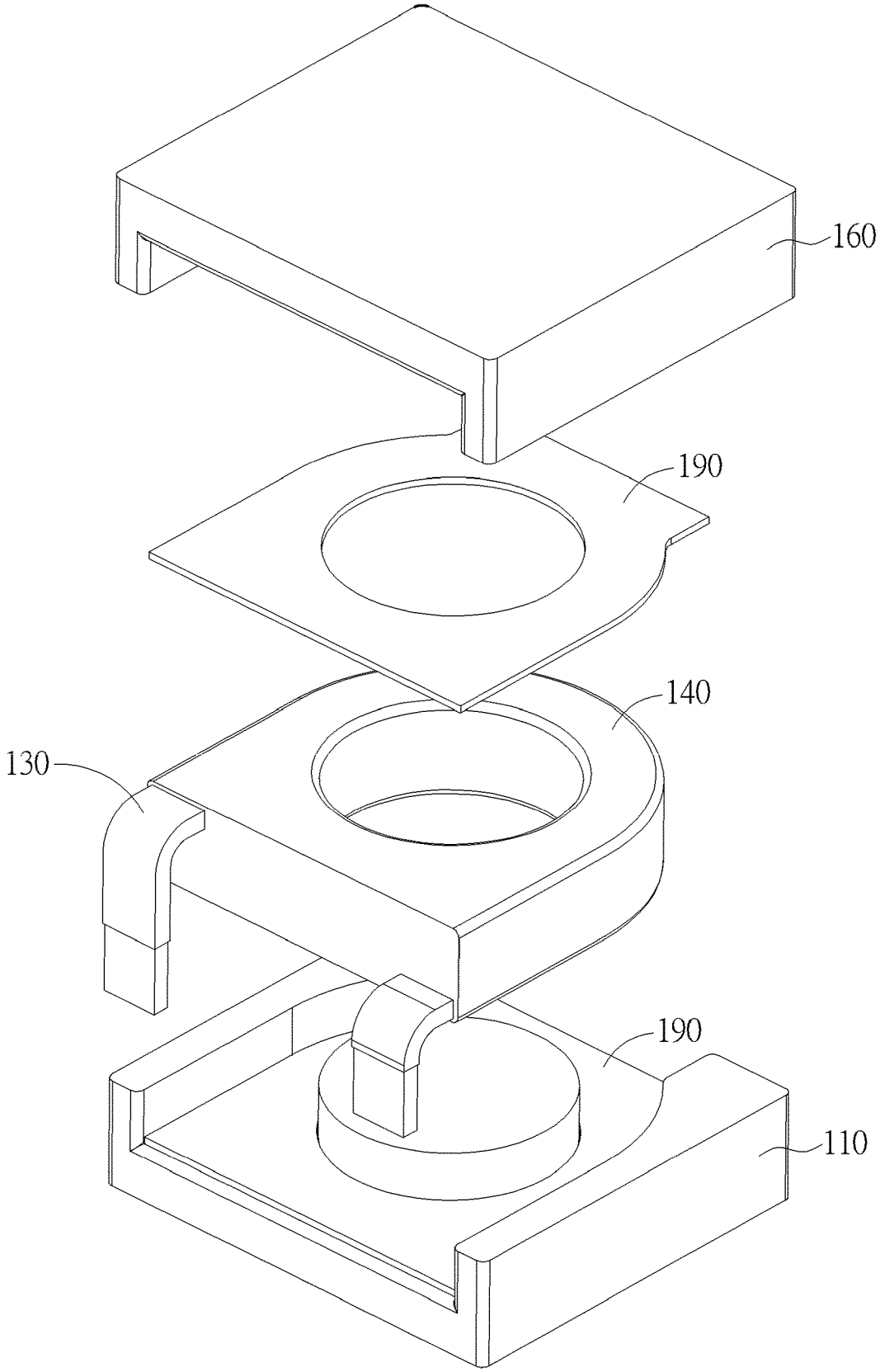
FIG. 13 is a perspective view illustrating the assembly of a magnetic component structure in accordance with still another embodiment of the present invention.

Next, please refer to FIG. 13. In this embodiment, unlike the one shown in FIG. 12, the thermal conductive filler 140 is not formed together with the lower magnetic core 110. It is formed individually by using a mold (not shown) with predetermined inner profile corresponding to the one of magnetic cores 110 and 160. The cured and shaped thermal conductive filler 140 would encapsulate the coil 130, and may be combined and well-fitted between the lower magnetic core 110 and the upper magnetic core 160 to form magnetic component structure. Similarly, a flexible thermal conductive interface material 190 may be disposed between the thermal conductive filler 140 and the upper magnetic core 160 or between the thermal conductive filler 140 and the lower magnetic core 110 to absorb the stress applied on the magnetic cores, fill possible gap between the thermal conductive filler 140 and the upper magnetic core 160, and provide better heat conductive property. The advantage of this embodiment is it provides better flexibility and design for assembly since the thermal conductive filler 140 and the magnetic cores 110, 160 are formed individually and may be assembled in adequate timing.

Figure 14A:
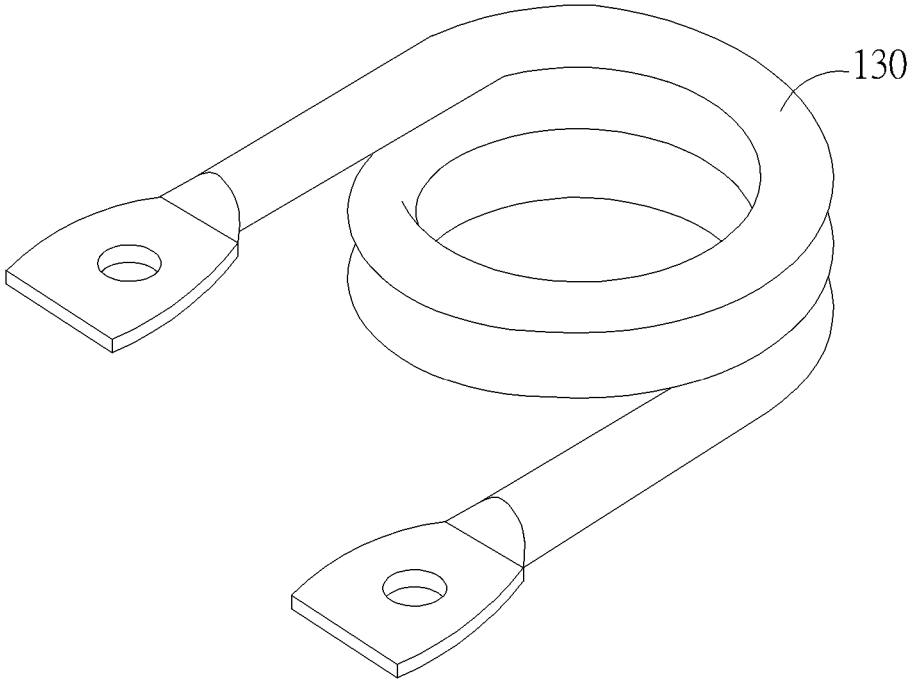
FIGS. 14*a* and 14*b* are perspective views of coils used in the magnetic component structure in accordance with one embodiment of the present invention.
Figure 14B:
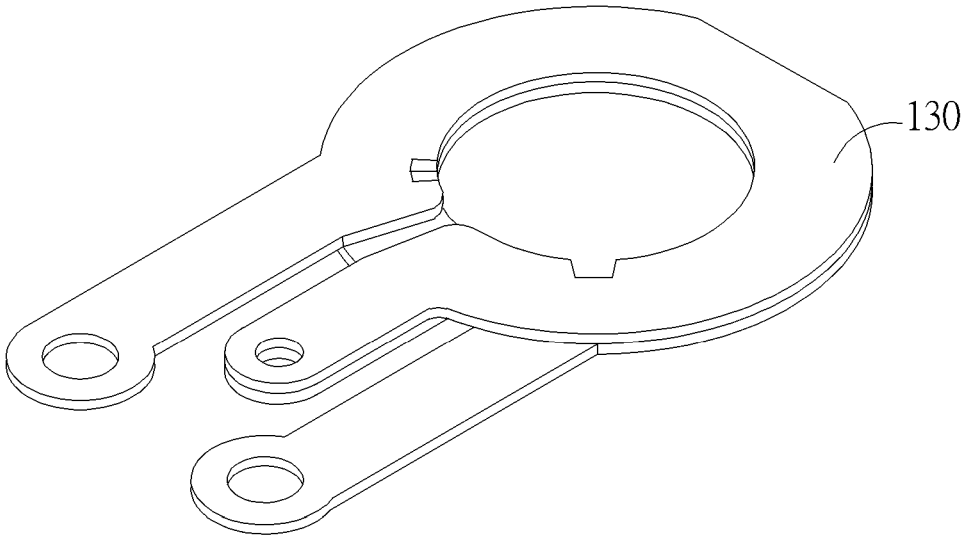

Lastly, please refer to FIGS. 14*a* and 14*b*, which are perspective views of two types of coils 130 used in the magnetic component structure in accordance with one embodiment of the present invention. FIG. 14*a* shows a coil 130 in a round wire type, while FIG. 14*b* shows a coil in a copper sheet type. Please note that the types of coil 130 identified above are merely exemplary embodiments, other types of coil, such as flat wire, stranded wire, stranded self-bonding wire or the combination thereof, may also be well applied in the present invention. If the coil is in a type of flat wire, copper sheet, or thick heavy round wire, the coil may be molded directly with the thermal conductive filler 140 without using bobbin. If the coil is in a type of round wire, stranded wire or composite wire, bobbin is required to fix the coil in the potting process like the one shown in FIG. 12.

In the present invention, the thermal conductive filler made by potting and curing thermal conductive material between the coil and the magnetic cores significant improves the heat dissipating efficiency of the magnetic component structure. Therefore, diameter of the coil, volume of the magnetic cores and total magnetic path may be further reduced to increase the inductance. The desired inductance may be obtained with smaller number of coils and smaller magnetic cores in this design and is advantageous to the electrical properties and manufacturing cost of the magnetic component structure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A magnetic component structure with thermal conductive filler, comprising:

an upper magnetic core;

a lower magnetic core, wherein said upper magnetic core and said lower magnetic core combines to form a casing with a front opening and a rear opening;

a coil mounted in said casing, where two terminals of said coil extending outwardly from said front opening;

a thermal conductive filler filling between said casing and said coil in said casing; and a thermal conductive interface material between said thermal conductive filler and said upper magnetic core or between said thermal conductive filler and said lower magnetic core, wherein a hardness of said thermal conductive interface material is smaller than a hardness of said thermal conductive filler, a hardness of said upper lower magnetic and a hardness of lower magnetic core.

2. The magnetic component structure with thermal conductive filler of claim 1, wherein said lower magnetic core is provided with a center column for said coil to be mounted thereon, and said center column extends upwardly from a mounting plane of said lower magnetic core and shifted from a center of said mounting plane to said front opening.

3. The magnetic component structure with thermal conductive filler of claim 1, wherein a surface of said thermal conductive filler is flush with said rear opening.

4. The magnetic component structure with thermal conductive filler of claim 1, wherein a portion of said thermal conductive filler projects from said rear opening.

5. The magnetic component structure with thermal conductive filler of claim 1, further comprising a bobbin mounted on said lower magnetic core, and said coil winds around said bobbin.

6. The magnetic component structure with thermal conductive filler of claim 5, wherein a material of said bobbin is plastics.

7. The magnetic component structure with thermal conductive filler of claim 1, further comprising an insulating paper or an insulating film between said coil and said upper magnetic core.

8. The magnetic component structure with thermal conductive filler of claim 1, wherein a thermal conductivity of said thermal conductive filler is larger than 0.3 W/mk.

9. The magnetic component structure with thermal conductive filler of claim 1, wherein a thermal conductivity of said thermal conductive interface material is larger than 0.3 W/mk.

10. The magnetic component structure with thermal conductive filler of claim 1, wherein said thermal conductive filler partially fills up said casing from said rear opening to said front opening.

11. The magnetic component structure with thermal conductive filler of claim 1, wherein said thermal conductive filler partially fills up said casing from a mounting plane of said lower magnetic core to said upper magnetic core.

12. The magnetic component structure with thermal conductive filler of claim 1, wherein a material of said upper magnetic core and said lower magnetic core comprises Fe—Si based alloy, Fe—Ni based alloy and ferrite.

13. The magnetic component structure with thermal conductive filler of claim 1, wherein a material of said thermal conductive filler comprises thermoset phenolic resins, thermoplastic polyethylene terephthalate (PET), polyamide (PA), polyphenylene sulfide (PPS) and polyetheretherketone (PEEK).

14. The magnetic component structure with thermal conductive filler of claim 1, wherein said front opening and said rear opening are opposite to each other respectively in two parallel and opposite directions of an expansion stress to reduce said expansion stress withstood for said upper magnetic core and said lower magnetic core.

15. The magnetic component structure with thermal conductive filler of claim 1, wherein said thermal conductive filler doesn't encapsulate outer surfaces of said upper magnetic core and said lower magnetic core.

* * * * *